US005538617A

United States Patent [19]

Steinbicker et al.

[11] Patent Number: 5,538,617

[45] Date of Patent: Jul. 23, 1996

[54] FERROCYANIDE-FREE HALOGEN TIN PLATING PROCESS AND BATH

[75] Inventors: Richard N. Steinbicker; Yung-Herng Yau, both of Allentown; Edward S. Fodor, Northampton, all of Pa.

[73] Assignee: Bethlehem Steel Corporation

[21] Appl. No.: 400,941

[22] Filed: Mar. 8, 1995

[51] Int. Cl.[6] ..... C25D 3/22

[52] U.S. Cl. ..... 205/302; 205/253; 205/101

[58] Field of Search ..... 205/302, 253, 205/101

[56] References Cited

U.S. PATENT DOCUMENTS

| | | | |
|---|---|---|---|
| 2,402,185 | 6/1946 | Schweikher | 204/54 |
| 2,407,579 | 9/1946 | Schweikher | 204/54 |
| 2,457,152 | 12/1948 | Hoffman | 204/54 |
| 2,461,507 | 2/1949 | Gray et al. | 204/54 |
| 2,512,719 | 6/1950 | Hull | 204/54 |
| 2,585,902 | 2/1952 | Gray | 204/54 |
| 2,736,692 | 2/1956 | Eckert | 204/54 |
| 2,758,075 | 8/1956 | Swalheim | 204/28 |
| 3,031,400 | 5/1960 | Tsu | 205/302 |
| 3,518,171 | 6/1970 | Merker et al. . | |
| 3,849,263 | 11/1974 | Gedde | 205/302 |
| 3,887,444 | 6/1975 | Fueki et al. | 204/43 S |
| 3,907,653 | 9/1975 | Horn | 204/94 |
| 3,915,812 | 10/1975 | Yamagishi et al. | 204/34 |
| 3,926,759 | 12/1975 | Horn et al. | 204/151 |
| 4,006,213 | 2/1977 | Fisher et al. | 204/54 R |
| 4,073,701 | 2/1978 | Steinbicker et al. | 204/54 R |
| 4,163,700 | 8/1979 | Igarashi et al. | 204/54 L |
| 4,329,207 | 5/1982 | Maruta | 204/54 L |
| 4,459,185 | 7/1984 | Obata et al. | 204/53 |
| 4,702,383 | 10/1987 | Babcock et al. | 210/638 |
| 4,717,460 | 1/1988 | Nobel et al. | 204/444 |
| 5,006,367 | 4/1991 | Lancsek | 427/129 |
| 5,094,726 | 3/1992 | Nobel et al. | 205/254 |
| 5,108,615 | 4/1992 | Hosea et al. | 210/668 |
| 5,110,423 | 5/1992 | Little et al. | 205/254 |
| 5,118,394 | 6/1992 | Makino et al. | 205/253 |
| 5,174,887 | 12/1992 | Federman et al. | 205/302 |
| 5,178,746 | 1/1993 | Darnall et al. | 205/287 |
| 5,185,076 | 2/1993 | Yanada et al. | 205/252 |
| 5,296,128 | 3/1994 | Gernon et al. | 205/302 |
| 5,298,168 | 3/1994 | Guess | 210/713 |
| 5,378,347 | 1/1995 | Thomson et al. | 205/302 |

FOREIGN PATENT DOCUMENTS

60389/86 2/1987 Australia .

*Primary Examiner*—John Niebling
*Assistant Examiner*—Kishor Mayekar

[57] ABSTRACT

Incorporating an additive into a tin electroplating bath substantially inhibits soluble ferrous ions, ferric ions, and stannous ions from reacting thus minimizing the formation of stannic tin which is lost in the plating sludge.

8 Claims, 7 Drawing Sheets none
0.05 M salicilic acid
0.05 M resorcinol
0.05 M catechol
0.05 M p-aminobenzoic acid
0.05 M gallic acid
0.05 M hydroquinone
none, w/o Fe
Δ Sn++, g/l
0
5
10
15
20
0
30
60
90
120
150
180
210
Oxygenation Time, minutes

FERROCYANIDE-FREE HALOGEN TIN PLATING PROCESS AND BATH

FIELD OF THE INVENTION

The present invention relates to a process for the high-speed tin plating of steel and a plating bath composition which is free of ferrocyanides.

BACKGROUND OF THE INVENTION

One of several known processes for the production of tinplated steel, high-speed halogen electroplating, typically uses plating baths which comprise stannous chloride, sodium bifluoride, sodium fluoride, sodium chloride and hydrochloric acid together with a grain-refining additive. In order to minimize corrosion of the steel as it is plated, however, the degree of acidity must be moderate (i.e., pH of between 3 to 4). Moderate acidity, in turn, requires that the stannous tin be combined with fluoride ions in a chemical complex in order to minimize the reaction of stannous tin with oxygen to form stannic tin which precipitates and is lost in the plating sludge. Dissolved iron in the plating bath accelerates the oxidation of fluoride-complexed stannous ions so that a substantial portion of the stannous ions are lost in the plating sludge. Thus, the iron, if not removed from the halogen plating bath, de-stabilizes the process resulting in off-quality tinplate, low productivity, and high costs for replenishment of tin and other chemicals.

To counteract the effect of iron, ferrocyanide is added in large quantities to the bath to remove dissolved iron from the electrolyte by forming insoluble compounds which report to the plating sludge. It is normally added as the sodium ferrocyanide decahydrate salt and results in the immediate and total precipitation of iron ions from the electrolyte before they react with oxygen and/or stannous tin. The use of alkali ferricyanides or ferrocyanides for this purpose is disclosed in U.S. Pat. Nos. 2,402,185 and 2,512,719.

These ferrocyanide additions result, however, in precipitated iron ferrocyanides which, along with insoluble stannic tin in the form of sodium fluostannate, become the major ingredients of a heavy sludge that accumulates in the plating cells, storage tanks, and throughout the recirculating system. Typically, halogen electroplating lines must be shut down periodically so that this sludge can be removed. In recent years, concern has been growing about the environmental impact of the ferrocyanide content of the plating section sludge, slurries, and waste waters.

Thus, there is a need to develop other ways to remove iron and/or stabilize a halogen plating bath so that the use of ferrocyanide can be discontinued.

SUMMARY OF THE INVENTION

The present invention relates to a weakly acidic halogen plating bath solution free of ferrocyanides for the electroplating of tin on an iron-based substrate. The plating bath solution contains a conductive electrolyte, stannous ions, and an effective amount of an additive incorporated into the plating bath sufficient to substantially inhibit soluble ferrous ions, ferric ions, and stannous ions from reacting in solution. This solution minimizes the formation of stannic tin, Sn(IV). The additive is preferably selected from the group consisting of para-aminobenzoic acid, hydroquinone, gallic acid, catechol, resorcinol, salicylic acid, ascorbic acid (L- or D-), citric acid, oxalic acid, formic acid, acetic acid, tartaric acid, glycine, diethyl hydroxylamine (DEHA), a mixture of citric acid and hydroquinone, and mixtures thereof.

Also disclosed is a method for minimizing the effect of dissolved iron in high-speed tin electroplating without the need for ferrocyanides which uses a weakly acidic halogen bath solution containing an additive in an amount sufficient to substantially inhibit soluble ferrous ions, ferric ions, and stannous ions from reacting in solution, to minimize the formation of stannic tin.

DETAILED DESCRIPTION OF THE INVENTION

Figure 1:
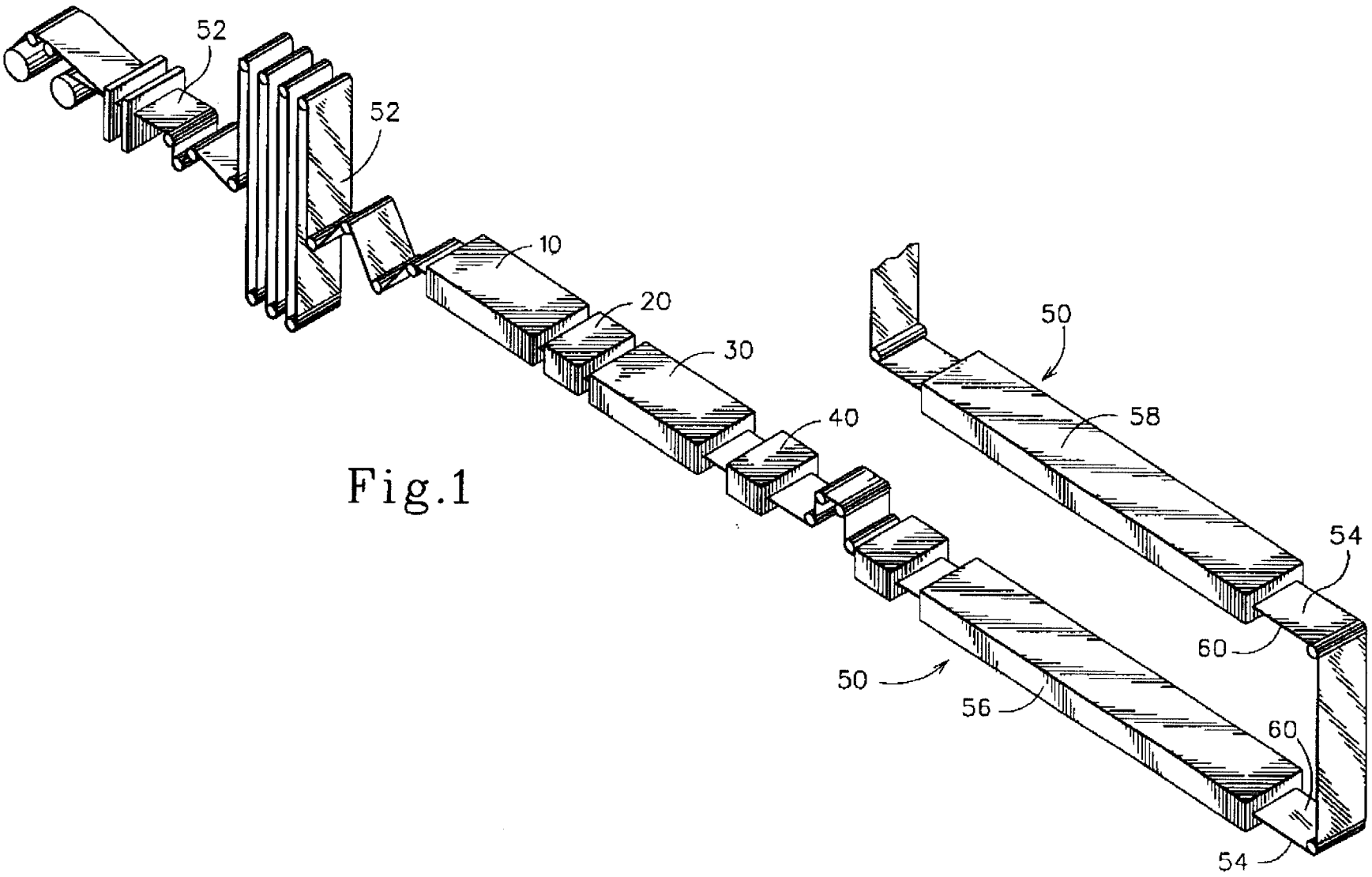
FIG. 1 shows a schematic arrangement of a portion of a high-speed halogen plating process.

The present invention uses chemical additives to stabilize halogen electroplating baths so that they may be used without ferrocyanide additions in the high-speed halogen tinplating of steel. FIG. 1 shows a horizontal, high-speed, halogen line having a cleaning tank 10, a first water rinsing unit 20, a surface activation unit 30, a second water rinsing unit 40, and a plating section 50.

A ferrous substrate, e.g. coiled steel 52, to be plated is first pretreated by cleaning and surface activation operations. These are accomplished by sequentially passing the substrate 52 through cleaning tank 10, first water rinsing unit 20, surface activation unit 30, and second water rinsing unit 40. The substrate 52 is then passed through plating section 50 which comprises a plurality of horizontal plating cells arranged on two plating decks, one above the other. The bottom side 54 of the substrate 52 is plated in the floor-level cells 56, and then the substrate 52 is diverted to the second level 58 where it reverses direction and passes through additional cells for plating the top side 60, which, because of the reversal, is actually the bottom surface in those plating cells. The horizontal plating cell geometry and high strip speeds result in a high degree of aeration of the plating bath. After exiting the plating section 50, the steel is given further processing according to well-known technology which is not shown, to result in a coil of tin plated steel that is ready for shipment to a customer.

The geometry of the halogen process equipment dictates the chemical requirements of the plating bath to be used. When using horizontal plating cells the degree of acidity must be moderate (i.e., a pH of from greater than zero up to about 6 and preferably between about 3 to about 4) in order to minimize corrosion, especially of the top surface of the steel strip as it passes through the first tier plating cells. In order to perform a high-speed tinplating operation, an acid plating bath, based on stannous rather than stannic ions, is required. The moderate acidity of the bath requires that the stannous ions ($Sn^{+2}$) in the bath be combined with fluoride ions in an anionic complex ($SnF_3^{-1}$). In this form, the reaction between dissolved oxygen resulting from a high degree of aeration of the bath and stannous tin is relatively slow, but it does result in the formation of tetravalent or stannic tin ion ($Sn^{+4}$). The stannic ion also combines with fluoride ions to form a complex fluostannate anion ($SnF_6^{-2}$) which has limited solubility and precipitates from the bath as a sodium salt ($Na_2SnF_6$).

It is believed that the effect of iron on the depletion of the stannous ions in the halogen bath occurs according to the following series of chemical reactions:

$$4Fe^{+2}+4H^{+}+O_2 \rightarrow 4Fe^{+3}+2H_2O \quad (1)$$

$$Fe^{+3}+3Na^{+}+6F^{-} \rightarrow Na_3FeF_6(s)\downarrow \quad (2)$$

$$2Fe^{+3}+Sn^{+2} \rightarrow 2Fe^{+2}+Sn^{+4} \quad (3)$$

$$2Sn^{+2}+O_2+4H^{+} \rightarrow 2Sn^{+4}+2H_2O \quad (4)$$

$$Sn^{+4}+2Na^{+}+6F^{-} \rightarrow Na_2SnF_6(s)\downarrow \quad (5)$$

Reaction 1 illustrates how free ferrous ions ($Fe^{+2}$) which enter an aerated plating bath react rapidly with the dissolved oxygen to form ferric ions ($Fe^{+3}$). These ferric ions then follow one of two courses: they either react with sodium and fluoride to form insoluble sodiumfluoferrate according to reaction 2 or they react with stannous tin to produce stannic tin according to reaction 3 (during which ferric ions are reduced back to the ferrous ions). Stannic tin will also be produced by the direct reaction of stannous tin with oxygen according to reaction 4.

In a system where no additional iron is introduced, the effect of reaction 3 (which occurs very quickly) would quickly dissipate with elimination of ferric ions by tile formation of sodium fluoferrate ($Na_3FeF_6$) which precipitates to the sludge according to reaction 2.

In a continuous plating line, however, iron contamination of the plating bath is persistent. It is believed that the majority of iron enters the conventional plating bath in three different ways in a typical halogen tinplating process. The first is by drag-in from the surface-activation step (acid treatment and water rinse) which precedes the plating process. The second is by dissociation of ferrocyanide ions to ferrous ions and cyanide ions. Corrosion of the steel strip top surface as the bottom is being plated is the third way.

Corrosion is believed to be the smallest contributor, mainly because iron is more noble than tin in the complex chemistry of the halogen bath. As soon as any tin is plated on the bottom surface, and especially as the deposit wraps around onto the top at the strip edges, the steel is galvanically protected and this greatly retards the dissolution of iron from the unplated top surface.

On the other hand, the effect of the dissociation of ferrocyanide ions is believed to be significant, depending on pH, temperature, and ferrocyanide concentration. In a ferrocyanide-free electrolyte, however, such dissociation would not be a source of iron. Thus, by discontinuing ferrocyanide additions, the most significant source of iron will be drag-in from the pre-treatment section. Although improvements can be made to reduce the amount of iron dragged into the bath, the problem cannot be totally avoided. As a result, reactions 1 and 3 take place continuously at rapid rates to produce the stannic tin ion.

Stannic tin ions are also produced at lower rates according to reaction 4. The stannic ions ultimately precipitate to the sludge as sodium fluostannate according to reaction 5. This continuous precipitation leads to a rapid decrease in the stannous concentration and a consequent decrease in the limiting current density of the plating process. Without the use of ferrocyanide to immediately precipitate iron, the stannous concentration may drop to a level where it is difficult or impossible to produce a high-quality tin coating. Moreover, to compensate for the precipitation of sodium fluostannate, higher tin and chemical replenishments must be made to the plating bath, thus resulting in higher operating costs.

Thus, according to the present invention, in order to negate the deleterious effects of iron on the tinplating process without using ferrocyanide addition to the bath, specific organic compounds and combinations thereof have been evaluated as additives to the halogen bath which slow down the depletion of divalent tin (i.e., stannous ions) from the electroplating process. These chemical additives either stabilize the ferrous ions in solution so that they are more slowly oxidized to the ferric ion (i.e., reaction 1 is retarded) or stabilize the stannous ions so that they react more slowly even in the presence of ferric ions (i.e., reactions 3 and 4 are minimized).

The additives found particularly effective in accomplishing the above include para-aminobenzoic acid, hydroquinone, gallic acid, catechol, resorcinol, salicylic acid, ascorbic acid (L- or D-), citric acid, oxalic acid, formic acid, acetic acid, tartaric acid, glycine, diethyl hydroxylamine (DEHA), mixtures of citric acid and hydroquinone, and mixtures thereof.

A method for minimizing the effect of dissolved iron in high-speed tin electroplating comprises incorporating the chemical additives discussed above in a weakly acidic halogen bath solution in an amount sufficient to substantially inhibit soluble ferrous ions, ferric ions, and stannous ions from reacting in the plating bath. As a result, these additives minimize the formation of stannic tin without the need for ferrocyanide additions.

The following examples illustrate the present invention. Halogen bath tin oxidation studies were performed in which oxygen was bubbled through 150 mL of a halogen bath plating solution containing 19.6 gms/l $NaHF_2$, 26.5 gms/l NaF, 12.68 gms/l NaCl, and 33.0 gms/l $SnF_2$, together with 1 ml/l of a commercial grain refining additive known in the trade as Agent 20, in a 250 mL graduated cylinder immersed in a water bath at 140° F. The electrolytes used for these experiments were typical of halogen tinplating baths and contained 25 g/l of total tin to initially yield 20–24 g/l of stannous ions. The mole ratio of fluoride to total tin was 8:1 and the initial pH of the solution was 3.4–3.5. The concentration of the addition agents in the experimental baths was set at 0.1 molar unless otherwise specified. Iron (1 g/l) was added at the beginning of the test as ferrous sulfate crystals ($FeSO_4.7H_2O$). To accelerate the oxidation process, either air or pure oxygen gas was sparged from the bottom of the container at 120 cc/min. The concentration of stannous ions was determined by titration every thirty or sixty minutes during a three or eight hour test period.

Tables 1 and 2 below tabulate the results of the oxidation studies using the additives of the present invention with Table 2 focused on ascorbic acid as a preferred additive. The effect of L- and D- ascorbic acid additives upon the oxidation of stannous ions was evaluated both with and without the addition of ferrous ions in the bath. Generally, the data show the depletion of stannous ions by oxidation in both cases. This oxidation is exacerbated, however, when ferrous ions are added to the bath. In order to determine the effectiveness of the additives, comparative examples were also run on baths free of addition agents both with and without ferrous ions in the bath. Also included were examples which included ferrocyanide additions. Table 3 tabulates results of oxidation studies on a halogen bath where either no additives, sodium ferrocyanide, or nitrogen were introduced into the bath.

In comparing Tables 1 and 2 with Table 3, the loss of stannous ions is seen to be lower when the additives of the present invention are incorporated into the bath than when no additions are made at all. In particular, the use of ascorbic acid as an additive is particularly effective. A comparison of run 3 of Table 2 with run 20 of Table 3 shows that a low concentration (e.g., 0.005 M) of L-ascorbic acid results in more than four times the concentration of stannous ions in the bath after 180 minutes of oxygen injection in the presence of iron added to the bath at an initial concentration of 1 g/l. An increase in the L-ascorbic acid concentration to 0.05 M (run 25 of Table 1) increases the amount of stannous ions to almost six times after 180 minutes of oxygen injection. Similarly, D-ascorbic acid, when used at a concentration off 0.05 M (run 27 of Table 1), increases the amount of stannous ions to over 6 times after 180 minutes of oxygen injection.

The additives used in Tables 1 and 3 have been abbreviated as follows:

PDHB=hydroquinone; MDHB=resorcinol;

ODHB=catechol; THBA=gallic acid;

AAA=glycine; DEHA=diethyl hydroxylamine;

PABA=para aminobenzoic acid; EDTA=ethylene diamine tetra acetic acid; and

AA-55 is known in the art as the designation for sodium ferrocyanide.

TABLE 1

| | | | | PRESENT INVENTION | | | | | | | | | |
|---|---|---|---|---|---|---|---|---|---|---|---|---|---|
| | | $Fe^{+2}$ | | | initial | final | Stannous Ion Concentration (g/l) | | | | | | |
| Run | Addition Agents | added g/l | Oxidant | Temp. F. | pH | pH | 0.0 | 30.0 | 60.0 | 90.0 | 120.0 | 150.0 | 180.0 (Min.) |
| 1 | 0.1M oxalic acid | 0.000 | $O_2$ 120 ml/min | 145 | 3.5 | — | 19.3 | 17.4 | 15.7 | 13.8 | 12.1 | 10.5 | 8.4 |
| 2 | 0.1M oxalic acid | 0.040 | $O_2$ 120 ml/min | 145 | 3.5 | — | 18.6 | 13.3 | 11.4 | 9.3 | 7.6 | 6.2 | 4.6 |
| 3 | 0.1M citric acid | 0.000 | $O_2$ 120 ml/min | 145 | 3.5 | — | 20.0 | 18.6 | 16.8 | 15.0 | 13.2 | 11.7 | 10.0 |
| 4 | 0.1M citric acid | 1.000 | $O_2$ 120 ml/min | 145 | 3.5 | — | 18.8 | 14.0 | 12.4 | 10.7 | 9.3 | 7.9 | 6.4 |
| 5 | 0.1M PDHB | 1.000 | $O_2$ 120 ml/min | 140 | — | 4.0 | 19.0 | 15.5 | 15.0 | 13.6 | 12.6 | 11.7 | 10.7 |
| 6 | 0.1M PAA | 1.000 | $O_2$ 120 ml/min | 140 | — | 4.5 | 18.2 | 15.5 | 12.0 | 8.1 | 4.3 | 2.0 | 0.0 |
| 7 | 0.1M EDTA | 1.000 | $O_2$ 120 ml/min | 140 | 3.5 | 4.0 | 21.9 | 13.6 | 10.7 | 8.1 | 6.0 | 4.1 | 1.9 |
| 8 | 0.02M PDHB | 1.000 | $O_2$ 120 ml/min | 140 | 3.5 | 4.4 | 21.9 | 15.7 | 14.3 | 12.6 | 11.2 | 9.5 | 7.9 |
| 9 | 0.05M PDHB | 0.000 | $O_2$ 120 ml/min | 140 | 3.5 | 4.3 | 21.7 | 20.7 | 20.2 | 19.3 | 18.3 | 17.6 | 16.9 |
| 10 | 0.05M PDHB | 1.000 | $O_2$ 120 ml/min | 140 | 3.5 | 4.5 | 21.7 | 17.6 | 16.7 | 15.2 | 14.0 | 12.6 | 11.4 |
| 11 | 0.05M PDHB | 0.500 | $O_2$ 120 ml/min | 140 | 3.4 | 4.4 | 24.5 | 21.4 | 19.8 | 19.0 | 17.6 | 16.9 | 16.0 |
| 12 | 0.05M PDHB | 0.200 | $O_2$ 120 ml/min | 140 | 3.4 | 4.4 | 24.5 | 21.7 | 20.7 | 19.8 | 19.0 | 18.1 | 17.1 |
| 13 | 0.05M MDHB | 0.000 | $O_2$ 120 ml/min | 140 | 3.4 | 4.5 | 25.0 | 23.8 | 22.9 | 21.2 | 19.8 | 18.3 | 17.4 |
| 14 | 0.05M MDHB | 1.000 | $O_2$ 120 ml/min | 140 | 3.4 | 4.5 | 25.0 | 18.3 | 16.9 | 15.0 | 13.6 | 11.9 | 11.0 |
| 15 | 0.05M ODHB | 0.000 | $O_2$ 120 ml/min | 140 | 3.4 | 4.0 | 24.5 | 22.9 | 22.4 | 21.2 | 20.5 | 19.8 | 19.0 |
| 16 | 0.05M ODHB | 1.000 | $O_2$ 120 ml/min | 140 | 3.4 | 4.3 | 24.5 | 18.3 | 17.4 | 16.7 | 16.0 | 13.1 | 12.6 |
| 17 | 0.05M 3,4,5 THBA | 0.000 | $O_2$ 120 ml/min | 140 | 3.4 | 4.1 | 24.5 | 23.6 | 22.6 | 21.4 | 20.7 | 19.5 | 18.3 |
| 18 | 0.05M 3,4,5 THBA | 1.000 | $O_2$ 120 ml/min | 140 | 3.4 | 4.3 | 24.5 | 19.8 | 18.8 | 17.1 | 15.2 | 14.3 | 13.1 |
| 19 | 0.1M EDTA | 0.000 | $O_2$ 120 ml/min | 140 | 3.4 | 4.1 | 24.5 | 22.6 | 20.9 | 19.5 | 17.6 | 16.4 | 14.8 |
| 20 | 0.05M AAA | 0.000 | $O_2$ 120 ml/min | 140 | 3.4 | 4.4 | 24.5 | 22.9 | 21.2 | 19.8 | 17.9 | 16.2 | 14.5 |
| 21 | 0.05M AAA | 1.000 | $O_2$ 120 ml/min | 140 | 3.4 | 4.7 | 24.5 | 15.0 | 13.8 | 12.6 | 11.9 | 11.2 | 10.0 |
| 22 | 0.10M PDHB<br>0.10M citric acid | 0.000 | $O_2$ 120 ml/min | 140 | 3.4 | 3.7 | 24.5 | 23.6 | 23.1 | 22.6 | 22.4 | 21.9 | 21.7 |
| 23 | 0.10M PDHB<br>0.10M citric acid | 1.000 | $O_2$ 120 ml/min | 140 | 3.4 | 3.7 | 24.5 | 21.4 | 20.9 | 20.5 | 19.5 | 19.3 | 18.8 |
| 24 | 0.05M L-ascorbic | 0.000 | $O_2$ 120 ml/min | 140 | 3.4 | 4.2 | 22.4 | 23.8 | 23.6 | 22.9 | 21.7 | 21.5 | 21.0 |
| 25 | 0.05M L-ascorbic | 1.000 | $O_2$ 120 ml/min | 140 | 3.4 | 4.2 | 22.4 | 22.4 | 21.3 | 20.8 | 19.8 | 19.1 | 18.4 |
| 26 | 0.05M D-ascorbic | 0.000 | $O_2$ 120 ml/min | 140 | 3.4 | 3.7 | 24.2 | 26.1 | 25.4 | 25.2 | 25.0 | 24.2 | 24.0 |
| 27 | 0.05M D-ascorbic | 1.000 | $O_2$ 120 ml/min | 140 | 3.4 | 3.7 | 24.2 | 23.5 | 23.4 | 22.8 | 22.3 | 21.0 | 20.9 |
| 28 | 0.05M PABA | 0.000 | $O_2$ 120 ml/min | 140 | 3.4 | 4.1 | 24.1 | 22.4 | 20.7 | 19.3 | 17.8 | 16.1 | 14.6 |
| 29 | 0.05M PABA | 1.000 | $O_2$ 120 ml/min | 140 | 3.4 | 4.4 | 24.1 | 19.1 | 17.5 | 16.3 | 15.2 | 13.9 | 12.9 |
| 30 | 0.05M salicylic | 0.000 | $O_2$ 120 ml/min | 140 | 3.4 | 4.2 | 24.1 | 22.1 | 19.8 | 17.7 | 15.1 | 13.5 | 12.0 |
| 31 | 0.06M salicylic | 1.000 | $O_2$ 120 ml/min | 140 | 3.4 | 4.4 | 24.1 | 16.5 | 14.4 | 12.5 | 10.4 | 9.2 | 7.6 |
| 32 | 0.05M DEHA | 0.000 | $O_2$ 120 ml/min | 140 | 3.4 | 4.5 | 22.2 | 20.7 | 19.7 | 18.4 | 17.5 | 16.9 | 15.8 |
| 33 | 0.05M DEHA | 1.000 | $O_2$ 120 ml/min | 140 | 3.4 | 4.7 | 22.2 | 15.8 | 15.4 | 14.5 | 13.7 | 13.2 | 12.9 |

TABLE 2

| Run | Addition Agents | $Fe^{+2}$ added g/l | Oxidant | Temp. F. | initial pH | final pH | Stannous Ion Concentration g/l) 0 | 60 | 120 | 180 | 240 | 300 | 360 | 420 | 480 (Min.) |
|---|---|---|---|---|---|---|---|---|---|---|---|---|---|---|---|
| 1 | 0.010M L-ascorbic | 1.000 | $O_2$ 120 ml/min | 140 | — | 4.6 | 25.2 | 19 | 17.7 | 16.9 | 15.4 | 14.3 | 13.1 | 11.9 | 10.5 |
| 2 | 0.025M L-ascorbic | 1.000 | $O_2$ 120 ml/min | 140 | — | 4.4 | 25.2 | 21.4 | 20 | 18.8 | 17.3 | 16.4 | 14.7 | 13.3 | 11.9 |
| 3 | 0.005M L-ascorbic | 1.000 | $O_2$ 120 ml/min | 140 | — | 5 | 23.8 | 17.3 | 15.8 | 14.3 | 12.7 | 11.4 | 10 | 8.8 | 6.7 |
| 4 | 0.05M L-ascorbic[1] | 1.000 | $O_2$ 120 ml/min | 140 | 3.4 | 4.2 | 22.4 | 21.3 | 19.8 | 18.4 | — | — | — | — | — |
| 5 | 0.05M D-ascorbic[2] | 1.000 | $O_2$ 120 ml/min | 140 | 3.4 | 3.7 | 24.2 | 23.4 | 22.3 | 20.9 | — | — | — | — | — |
| 6 | none | 0.000 | $O_2$ 120 ml/min | 140 | 3.4 | 4.7 | 23.8 | 20.9 | 18.1 | 15.9 | 13.4 | 11.3 | 10.1 | 9.4 | 9 |
| 7 | none | 1.000 | $O_2$ 120 ml/min | 140 | 3.4 | 4.6 | 23.7 | 12.1 | 7.1 | 3.3 | — | — | — | — | — |

[1]Run 25 Table 1
[2]Run 27 Table 1

TABLE 3

| Run | Addition Agents | $Fe^{+2}$ added g/l | Oxidant | Temp. F. | initial pH | final pH | Stannous Ion Concentration (g/l) 0.0 | 30.0 | 60.0 | 90.0 | 120.0 | 150.0 | 180.0 (Min.) |
|---|---|---|---|---|---|---|---|---|---|---|---|---|---|
| 1 | none | 0.000 | $O_2$ 120 ml/min | 145 | 4 | — | 20.8 | 19.0 | 17.6 | 15.5 | 13.3 | 11.4 | 9.5 |
| 2 | none | 1.000 | $O_2$ 120 ml/min | 145 | 4 | — | 20.0 | 11.4 | 9.0 | 6.4 | 3.8 | 2.4 | 1.4 |
| 3 | 3 g/l AA-55 | 0.000 | $O_2$ 120 ml/min | 140 | 3.4 | 4.7 | 24.5 | 23.0 | 21.9 | 20.7 | 19.5 | 17.9 | 17.1 |
| 4 | 3 g/l AA-55 | 1.000 | $O_2$ 120 ml/min | 140 | 3.4 | 4.8 | 24.5 | 17.1 | 16.0 | 14.3 | 13.1 | 12.4 | 11.2 |
| 5 | none | 0.000 | $O_2$ 120 ml/min | 140 | 3.4 | 4.5 | 24.8 | 22.6 | 20.5 | 18.6 | 17.1 | 16.2 | 13.1 |
| 6 | none | 0.200 | $O_2$ 120 ml/min | 140 | 3.4 | 4.7 | 24.8 | 19.3 | 17.6 | 16.0 | 14.0 | 11.7 | 10.2 |
| 7 | none | 0.000 | AIR 120 ml/min | 140 | — | 3.7 | 24.0 | 24.0 | 23.8 | 23.3 | 23.3 | 22.9 | 22.6 |
| 8 | none | 0.056 | AIR 120 ml/min | 140 | — | 3.8 | 24.0 | 23.3 | 22.9 | 22.6 | 22.1 | 21.7 | 21.2 |
| 9 | none | 0.113 | AIR 120 ml/min | 140 | — | 3.8 | 24.0 | 22.9 | 22.4 | 21.7 | 21.4 | 20.7 | 20.5 |
| 10 | none | 0.565 | AIR 120 ml/min | 140 | — | 3.9 | 24.0 | 20.7 | 19.8 | 19.3 | 18.6 | 18.6 | 17.9 |
| 11 | none | 0.000 | AIR 120 ml/min | 140 | — | 4.1 | 24.3 | 24.0 | 24.0 | 23.8 | 23.6 | 23.1 | 23.1 |
| 12 | none | 1.000 | AIR 120 ml/min | 140 | — | 4.4 | 24.3 | 19.5 | 18.6 | 17.9 | 17.1 | 16.9 | 16.4 |
| 13 | none | 0.000 | AIR 120 ml/min | 140 | 3.4 | 3.7 | 23.9 | 23.6 | 23.5 | 23.4 | 23.0 | 22.9 | 22.8 |
| 14 | none | 0.056 | AIR 120 ml/min | 140 | 3.4 | 3.8 | 23.9 | 22.0 | 21.0 | 21.0 | 20.7 | 20.7 | 20.6 |
| 15 | none | 0.113 | AIR 120 ml/min | 140 | 3.4 | 4.0 | 23.9 | 20.6 | 20.2 | 20.2 | 19.6 | 19.6 | 19.3 |
| 16 | none | 0.226 | AIR 120 ml/min | 140 | 3.4 | 4.2 | 23.9 | 22.0 | 20.4 | 19.8 | 19.8 | 19.7 | 19.6 |
| 17 | $N_2$ 120 ml/min | 0.000 | none | 140 | 3.4 | 3.4 | 23.0 | 22.9 | 22.9 | 22.9 | 22.9 | 22.9 | 22.9 |
| 18 | $N_2$ 120 ml/min | 0.565 | none | 140 | 3.4 | 3.5 | 22.9 | 22.2 | 22.2 | 22.2 | 22.2 | 22.2 | 22.2 |
| 19 | $N_2$ 120 ml/min | 0.565 | none | 140 | 3.4 | 3.6 | 22.9 | 21.6 | 21.6 | 21.7 | 21.8 | 21.7 | 21.8 |
| | | $Fe^{+3}$ | | | | | | | | | | | |
| 20 | none | 1.000 | $O_2$ 120 ml/min | 140 | 3.4 | 4.6 | 23.7 | 14.9 | 12.1 | 9.2 | 7.1 | 4.8 | 3.3 |
| 21 | none | 0.000 | $O_2$ 120 ml/min | 140 | — | 3.8 | 25.2 | 22.0 | 19.1 | 16.6 | 14.7 | 14.0 | 13.8 |
| 22 | none | 0.000 | $O_2$ 120 ml/min | 140 | — | 3.7 | 25.1 | 23.5 | 21.9 | 20.6 | 19.3 | 17.7 | 16.4 |

From the data in Table 1, it has been determined that when the stannous ion concentration is in the range of 8 to 25 g/l the stannous ion oxidation rate is independent of the stannous ion concentration. Thus the change in stannous ion concentration, $\Delta Sn^{+2}$, of the data is discussed below and graphically displayed in FIGS. 2–7 in order to eliminate the need to consider small variations in the starting stannous ion concentrations. It should be noted that, for all of the additives of the present invention, the $\Delta Sn^{+2}$ versus time curves shown in FIGS. 3–7 exhibit basically the same shape, i.e., a sudden decrease in the stannous ion concentration in the first thirty minutes (represented in the graphs by a sharp increase in the slope of the $\Delta Sn^{+2}$ versus time curves) followed by a linear region of decreasing stannous ion concentration (represented in the graphs by a continued increase in the slope of the $\Delta Sn^{+2}$ versus time curves but at a more gradual rate) similar to that which results in the absence of iron.

It is believed that this initial deleterious effect of iron in increasing the oxidation rate of stannous ions corresponds to reaction 3 discussed above and diminishes quickly as the stable sodium fluoferrate compound is formed according to reaction 2 above. It is also theorized that the linear region of decreasing stannous ion concentration corresponds to the continued direct oxidation of stannous ions in solution according to reaction 4 above. The data of Tables 1, 2, and 3 were used to prepare the graphs of FIGS. 2–7 which serve to further explain the present invention with regard to the effect of the additives of the present invention upon stannous ion depletion by both of these mechanisms.

Figure 2:
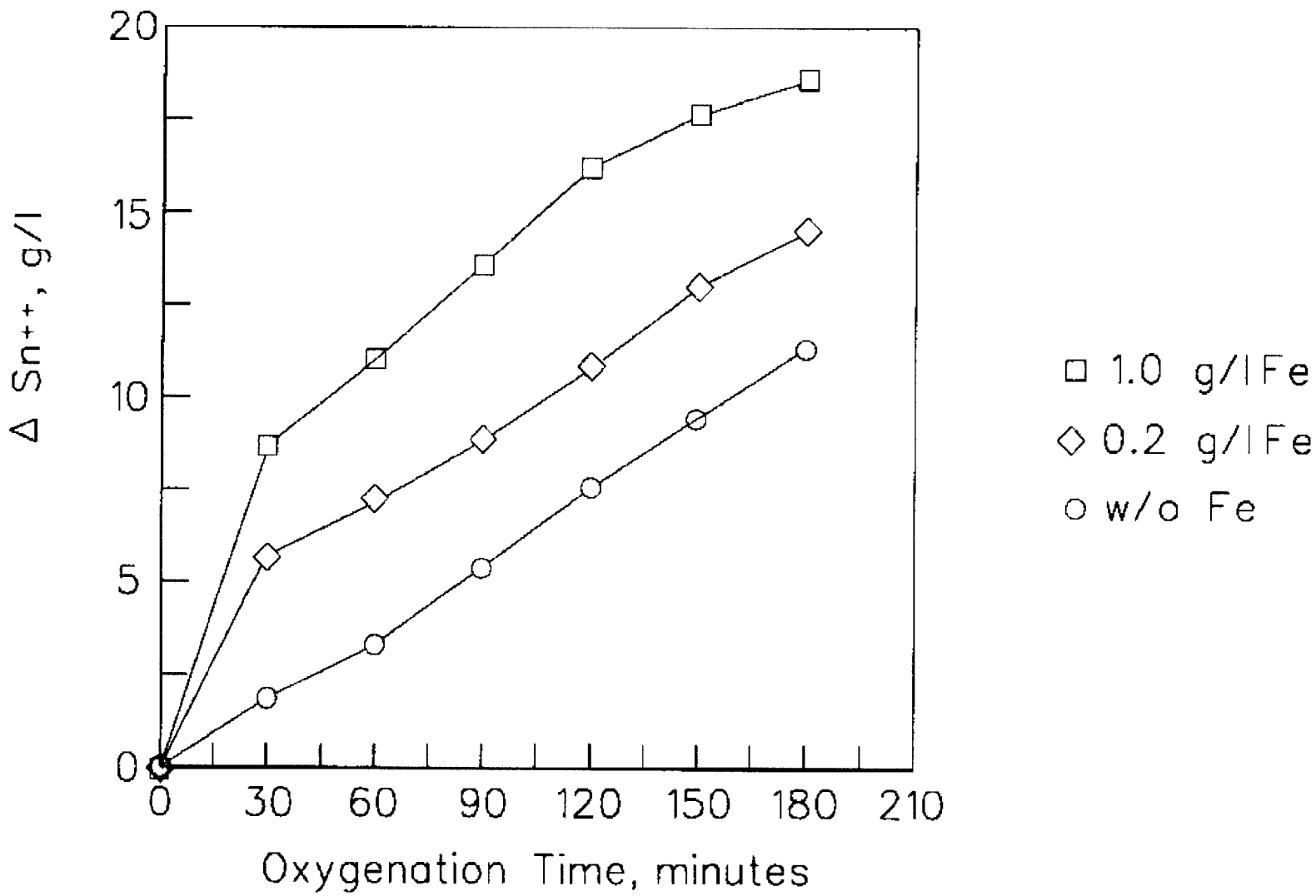
FIG. 2 is a graph showing the effect of ferrous iron on the oxidation of stannous ions in a conventional halogen bath without ferrocyanides or other additives.

FIG. 2 shows, as a comparative baseline, the effect of oxygen on the stannous tin concentration, without iron added and with iron added in concentrations of 0.2 g/l (200 ppm) and 1.0 g/l (1,000 ppm) as solid ferrous sulfate ($FeSO_4.7H_2O$) at the beginning of the experiment. The effect of iron on accelerating the oxidation of $Sn^{+2}$ is very strong and occurs during the initial minutes of oxygenation (i.e., during the first 30 minutes of oxygenation), after which the oxidation rate is essentially the same as without iron. Furthermore, in the case of iron additions, a white powdery precipitate formed during the initial minutes. This powder was identified as the complex ferric salt, sodium fluoferrate ($Na_3FeF_6$), by X-ray diffraction and by Energy Dispersive Spectroscopy.

Figure 3:
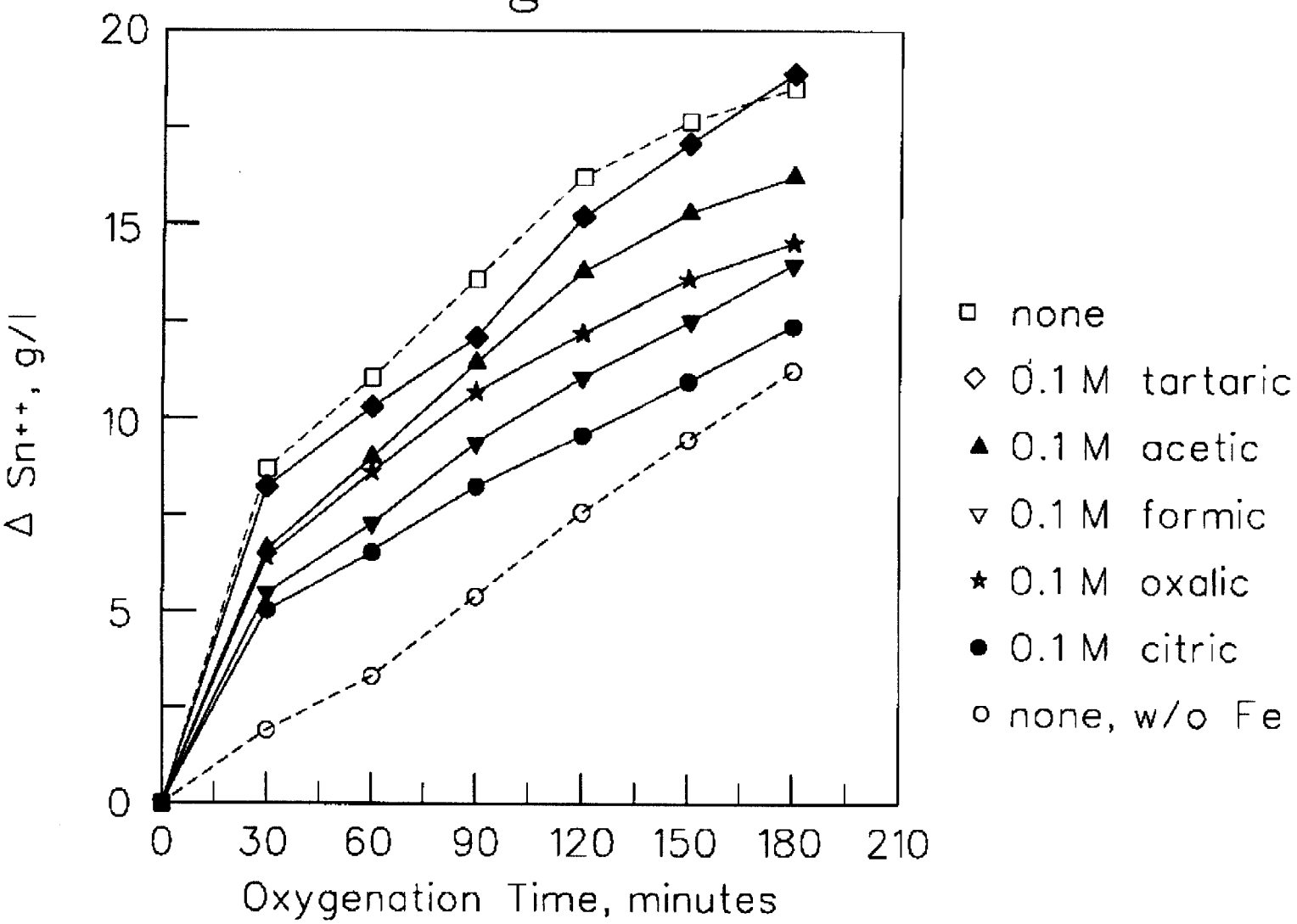
FIG. 3 is a graph showing the effect of certain carboxylic acid addition agents on the oxidation of stannous ions in a halogen bath in accordance with the present invention.

FIG. 3 shows the effect of 0.10 molar concentrations of carboxylic acids, namely acetic, oxalic, citric, formic, and tartaric acids, on the oxidation of stannous tin. Citric acid reduced the initial effect of iron by almost 50% and also reduced the continued direct oxidation of stannous ions, as evidenced by the change in slope of the linear portion of the curve. Oxalic acid was nearly as effective in mitigating the iron effect, but did not have as strong an effect on continued direct stannous oxidation. The impact of the other carboxylic acids, although not as great, still shows an improvement over using no addition agent at all.

Figure 4:
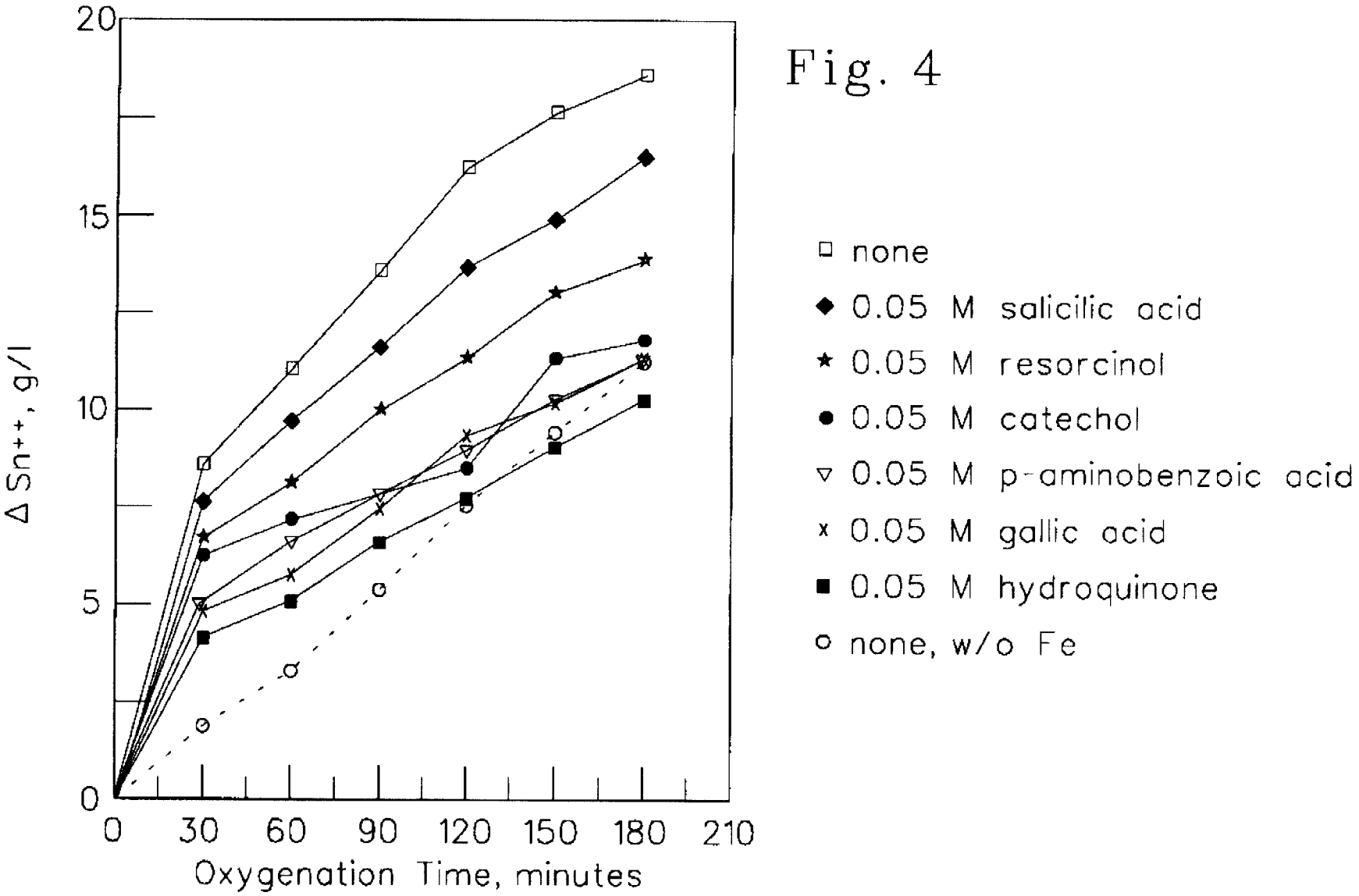
FIG. 4 is a graph showing the effect of certain aromatic compound addition agents on the oxidation of stannous ions in a halogen bath in accordance with the present invention.

FIG. 4 shows the effect of 0.05 molar concentrations of six aromatic compounds, namely, gallic acid, hydroquinone and its two isomers (resorcinol and catechol), para-aminobenzoic acid, and salicylic acid. All of these additives reduced the initial iron effect to a certain extent and most had a strong impact on the continued direct oxidation of stannous ion. Hydroquinone had a very strong effect in reducing both the initial impact of iron and the continued direct oxidation of stannous ions. Gallic acid and para-aminobenzoic acid were also nearly as effective as hydroquinone. Catechol, resorcinol, and salicylic acid were also found to have the effect of lowering the oxidation rate of stannous ions. Thus, aromatic compounds were found to be effective in both reducing the initial effect of iron and lowering the continued direct oxidation rate of stannous ions in the plating bath.

Figure 5:
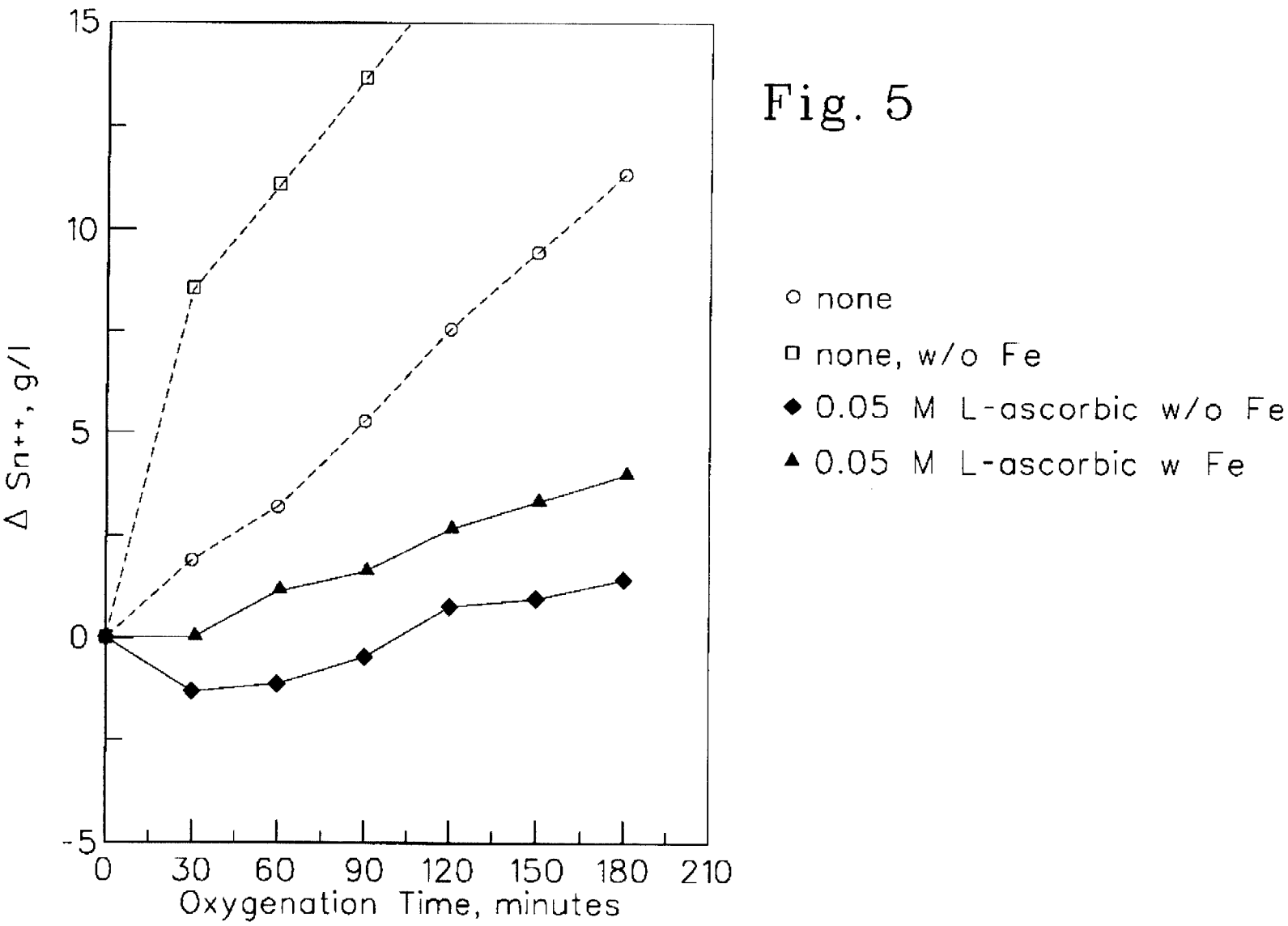
FIG. 5 is a graph showing the effect of L-ascorbic acid and D-ascorbic acid addition agents on the oxidation of stannous ions in a halogen bath in accordance with the present invention.

FIG. 5 shows the profound effect 0.05 M L-ascorbic acid have on both the initial effect of iron and the continued direct oxidation of stannous ions in the plating bath. It can be seen, by the negative slope in the curve in the case where no iron is added to the bath, that the stannous ion concentration increases during the first thirty minutes of oxygenation when using L-ascorbic acid. It is believed that ascorbic acid actually reacts with up to an equivalent weight of stannic ions which may be present in the bath, reducing them back to stannous ions. When iron is added to the bath, the ascorbic acid eliminates the initial deleterious effect and also has a very strong impact on the continued direct oxidation of stannous tin. Moreover, as shown in the tables it should be noted that the addition of 0.05 M L- or D-ascorbic acid makes a bath with 1.0 g/l of iron more stable than even a bath containing no iron and no additives.

Figure 6:
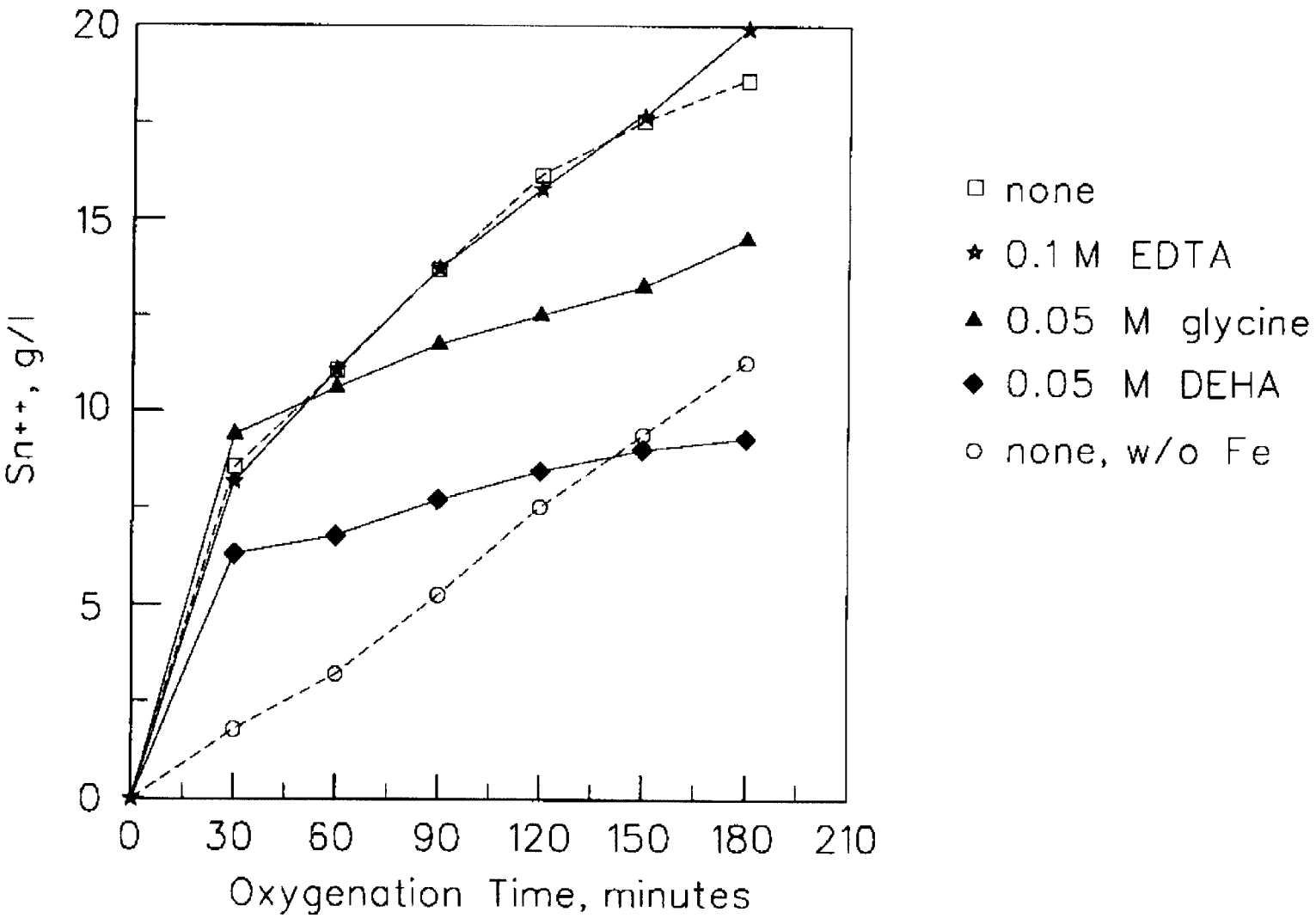
FIG. 6 is a graph showing the effect of certain aliphatic compound addition agents on the oxidation of stannous ions in a halogen bath in accordance with the present invention.

FIG. 6 shows the effect of aliphatic compounds, namely, 0.05 M additions of glycine (aminoacetic acid), 0.10 M ethylenediaminetetraacetic acid (EDTA), and 0.05 M N, N diethylhydroxylamine (DEHA). DEHA reduced both the initial iron effect and the continued direct oxidation of the stannous ion in the plating bath. Although glycine was found to slightly increase the initial iron effect, this compound was found to be effective in reducing the continued direct oxidation of stannous ions. EDTA did not greatly impact the initial iron effect or the continued direct oxidation of the stannous ions in the bath.

Figure 7:
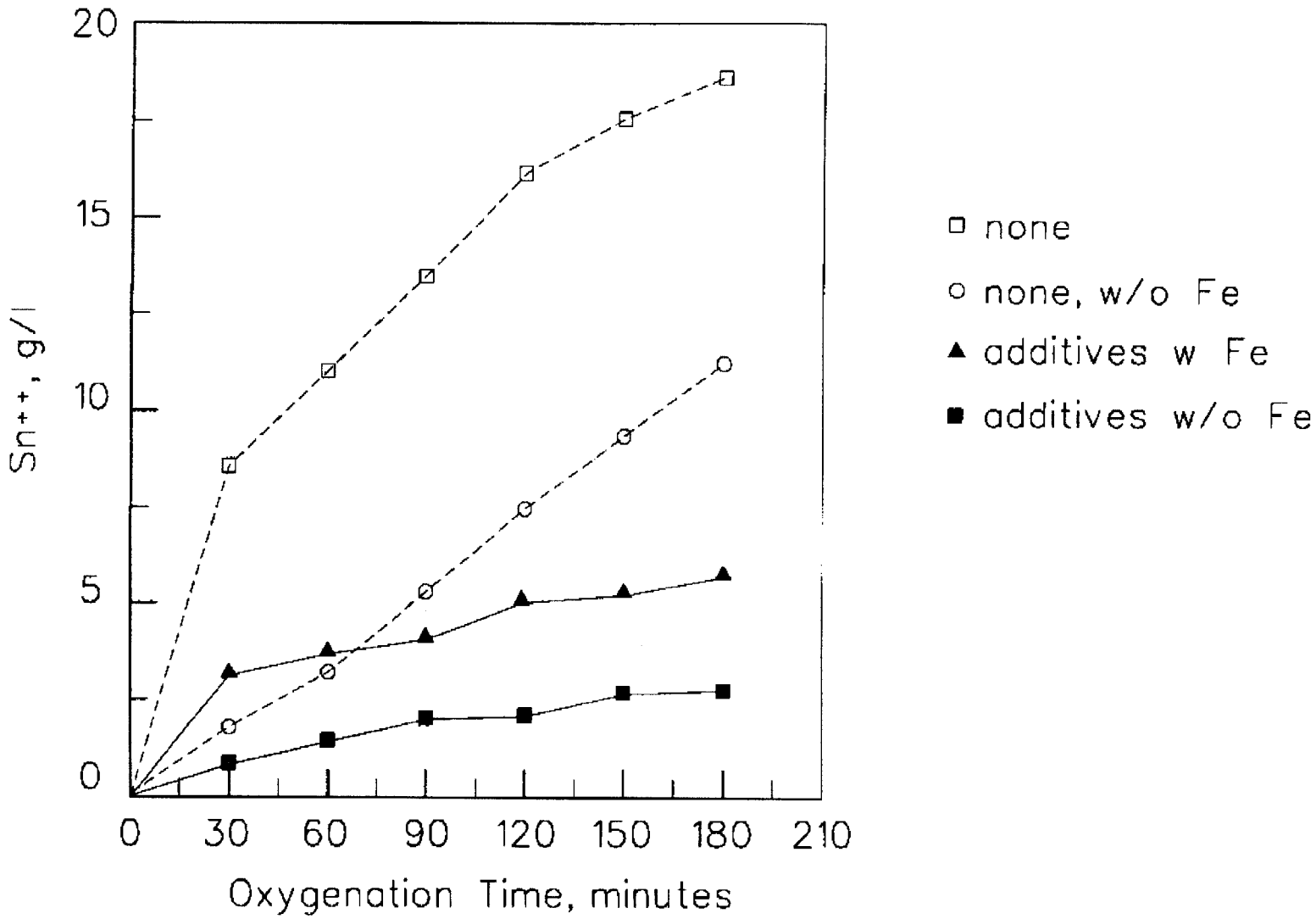
FIG. 7 is a graph showing the confined effect of hydroquinone and citric acid addition agents on the oxidation of stannous ions in a halogen bath in accordance with the present invention.

FIG. 7 shows the combined effects of citric acid, the most effective of the carboxylic acids tested above, and hydroquinone, the most effective aromatic compound tested above. The effects of adding a combination of 0.1 citric acid and 0.1 hydroquinone are a very sharp decrease in the initial effect of iron and a large reduction in the continued direct oxidation of stannous ions in the bath.

Although the additives (and methods for using them) disclosed above are effective when used alone or in combination to stabilize the stannous tin concentrations in halogen plating baths, they may also be used in conjunction with other iron removal technologies. It is contemplated that these addition agents, when used in this manner, may stabilize iron ions in the plating bath for a time sufficient to permit circulation of the bath through an iron removal apparatus, such as ion exchange columns or molecular recognition technology, to remove them from a plating bath. Because these iron removal systems require time to process the bath, it is believed that the addition agents disclosed will permit the use of these slower iron removal systems in a high-speed plating line which in the past required that iron be removed rapidly from the plating bath (i.e., with sodium ferrocyanide).

It is also within the scope of the present invention to use the additives to stabilize non-halogen tin plating baths.

While the invention has been described herein with reference to specific embodiments, it is not limited thereto. Rather it should be recognized that this invention may be practiced as outlined above within the spirit and scope of the appended claims, with such variants and modifications as may be made by those skilled in this art.

What is claimed:

1. A weakly halogen acidic plating bath free of ferrocyanide ions for high-speed tin electroplating of steel comprising a conductive electrolyte, soluble ferrous ions, ferric ions, and stannous ions together with an effective amount of an additive selected from the group consisting of para-aminobenzoic acid, gallic acid, catechol, resorcinol, salicylic acid, citric acid, oxalic acid, formic acid, acetic acid, tartaric acid glycine, diethyl hydroxylamine (DEHA), mixtures of citric acid and hydroquinone, and mixtures thereof to substantially inhibit soluble ferrous ions, ferric ions, and stannous ions from reacting, to minimize the formation of stannic tin.

2. A plating bath as recited in claim 1 wherein said plating bath has a pH in the range of greater than 0 to about 6.

3. A plating bath as recited in claim 2 wherein said plating bath has a pH in the range of from about 3 to about 4.

4. A method for minimizing the effect of dissolved iron in high-speed tin electroplating using a weakly acidic plating bath solution free of ferrocyanide comprising:

adding to a halogen plating bath containing a conductive electrolyte, soluble ferrous ions, ferric ions, and stannous ions, an additive selected from the group consisting of para-aminobenzoic acid, gallic acid, catechol, resorcinol, salicylic acid, citric acid, oxalic acid, formic acid, acetic acid, tartaric acid, glycine, diethyl hydroxylamine (DEHA), mixtures of citric acid and hydroquinone, and mixtures thereof in an amount sufficient to substantially inhibit soluble ferrous ions, ferric ions, and stannous ions from reacting, to minimize the formation of stannic tin.

5. A method for minimizing the effect of dissolved iron in high-speed tin electroplating as recited in claim 4 further comprising the step of removing said ferrous ions from said halogen plating bath by recirculating a portion of said bath through an iron removal apparatus.

6. A method for minimizing the effect of dissolved iron in high-speed tin electroplating as recited in claim 4 wherein said halogen plating bath solution has a pH in the range of greater than 0 to 6.

7. A method for minimizing the effect of dissolved iron in high-speed tin electroplating as recited in claim 4 wherein said halogen plating bath solution has a pH in the range of from about 3 to about 4.

8. A weakly acidic halogen plating bath solution free of ferrocyanide for use as a tin electroplating bath, said bath containing soluble ferrous ions, ferric ions, and stannous ions and an additive to inhibit said ions from reacting to form stannic tin, said additive selected from the group consisting of para-aminobenzoic acid, gallic acid, catechol, resorcinol, salicylic acid, citric acid, oxalic acid, formic acid, acetic acid, tartaric acid, glycine, diethyl hydroxylamine (DEHA), mixtures of citric acid and hydroquinone, and mixtures thereof.

* * * * *